US007080493B2

(12) United States Patent
Baldanza et al.

(10) Patent No.: US 7,080,493 B2
(45) Date of Patent: Jul. 25, 2006

(54) MACHINE FOR APPLYING PARTLY ADHESIVE STRAPS TO RELATIVE PRODUCTS

(75) Inventors: Luca Baldanza, Casalacchio di Reno (IT); Giuliano Bertusi, Monzuno (IT); Mirko Cassoli, Marconi (IT)

(73) Assignee: KPL Packaging S.p.A., Casalecchio di Reno (IT)

( * ) Notice: Subject to any disclaimer, the term of this patent is extended or adjusted under 35 U.S.C. 154(b) by 0 days.

(21) Appl. No.: 10/948,080

(22) Filed: Sep. 23, 2004

(65) Prior Publication Data

US 2005/0155323 A1 Jul. 21, 2005

(30) Foreign Application Priority Data

Sep. 26, 2003 (EP) ..... 03425622

(51) Int. Cl.
*B65B 61/14* (2006.01)

(52) U.S. Cl. ..... 53/134.1; 493/226; 493/926

(58) Field of Classification Search ..... 53/413, 53/134.1; 493/88, 226, 926; B65B 61/14
See application file for complete search history.

(56) References Cited

U.S. PATENT DOCUMENTS

| | | | | |
|---|---|---|---|---|
| 4,700,528 | A * | 10/1987 | Bernard | 53/413 |
| 4,758,301 | A * | 7/1988 | Inoko et al. | 156/361 |
| 5,458,726 | A * | 10/1995 | Castoldi | 53/134.1 |
| 6,234,230 | B1 * | 5/2001 | Petitjean | 156/522 |
| 6,513,657 | B1 * | 2/2003 | Sheehan, Jr. | 53/413 |
| 6,826,890 | B1 * | 12/2004 | Cere' | 53/134.1 |
| 2003/0101685 | A1 * | 6/2003 | Jansen et al. | 53/134.1 |

FOREIGN PATENT DOCUMENTS

| | | |
|---|---|---|
| EP | 0560699 A * | 9/1993 |
| FR | 2 678 238 | 12/1992 |
| JP | 63-33238 | 2/1988 |

* cited by examiner

*Primary Examiner*—Stephen F. Gerrity
(74) *Attorney, Agent, or Firm*—Seed IP Law Group PLLC

(57) ABSTRACT

A machine for applying partly adhesive straps to relative products has a folding device located between an input station, where the products are fed onto the machine, and an output station, where the products are fed off the machine; a feed device for feeding the straps successively to the input of the folding device; and a conveying device for feeding the products continuously along a substantially straight path extending between the input station and the output station, so that each strap is folded into a U about the relative product at the folding device.

16 Claims, 3 Drawing Sheets

MACHINE FOR APPLYING PARTLY ADHESIVE STRAPS TO RELATIVE PRODUCTS

BACKGROUND OF THE INVENTION

1. Field of the Invention

The present invention relates to a machine for applying partly adhesive straps to relative products.

More specifically, the present invention relates to a machine for applying partly adhesive straps to relative products, each of which is defined by an article and by a sheet of packing material enclosing the article. In the following description, the articles referred to are rolls of paper considered either singly or in groups comprising a number of adjacent, aligned rolls of paper, to which the following description refers purely by way of example.

2. Description of the Related Art

In the manufacture of rolls of paper, the rolls are formed into packages, each produced by wrapping a sheet of plastic or similar packaging material about one or more rolls of paper; and the finished packages are fed to a so-called "strapping" machine for applying a partly adhesive strap to each package, i.e., a strap enabling the package to be carried easily by the consumer.

The machine normally comprises a conveying device for feeding each package in steps in a first given direction to a packing station having a transverse pusher, which moves the package in a second direction perpendicular to the first direction and against a partly adhesive strap, which is thus folded substantially into a U about the package.

Known machines of the above type have several drawbacks, mainly due to step operation of the conveying device reducing the output rate of the machine.

Another drawback of known machines of the above type is that, for relatively high operating speeds, the pusher must have at least two degrees of freedom to reduce downtime by traveling back and forth along different paths. Pushers of this type are normally bulky and expensive, and, over and above a given operating speed, generate inertial vibration which is rarely acceptable.

BRIEF SUMMARY OF THE INVENTION

It is an object of the present invention to provide a machine for applying partly adhesive straps to relative products, designed to eliminate the aforementioned drawbacks.

According to the present invention, there is provided a machine for applying partly adhesive straps to relative products, the machine comprising an input station; an output station; conveying means for feeding the products successively along a path extending between said input and output stations; a folding device located along said path; and a feed device for feeding straps onto said path and into a position crosswise to the path; said conveying means feeding each product and the relative strap through said folding device so as to fold the strap into a U about the product.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
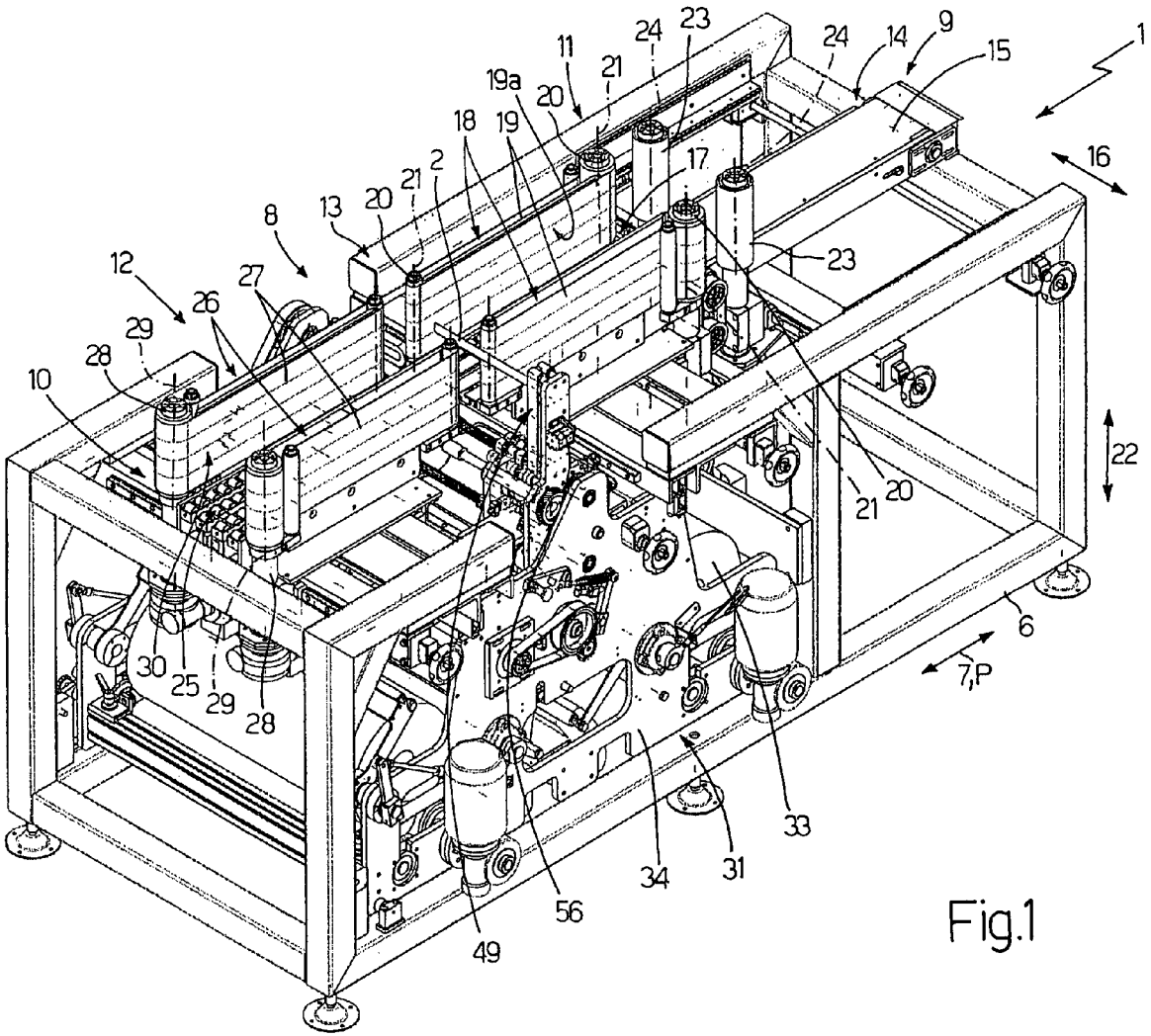
FIG. 1 shows a schematic view in perspective, with parts removed for clarity, of a preferred embodiment of the machine according to the present invention.
Figure 2:
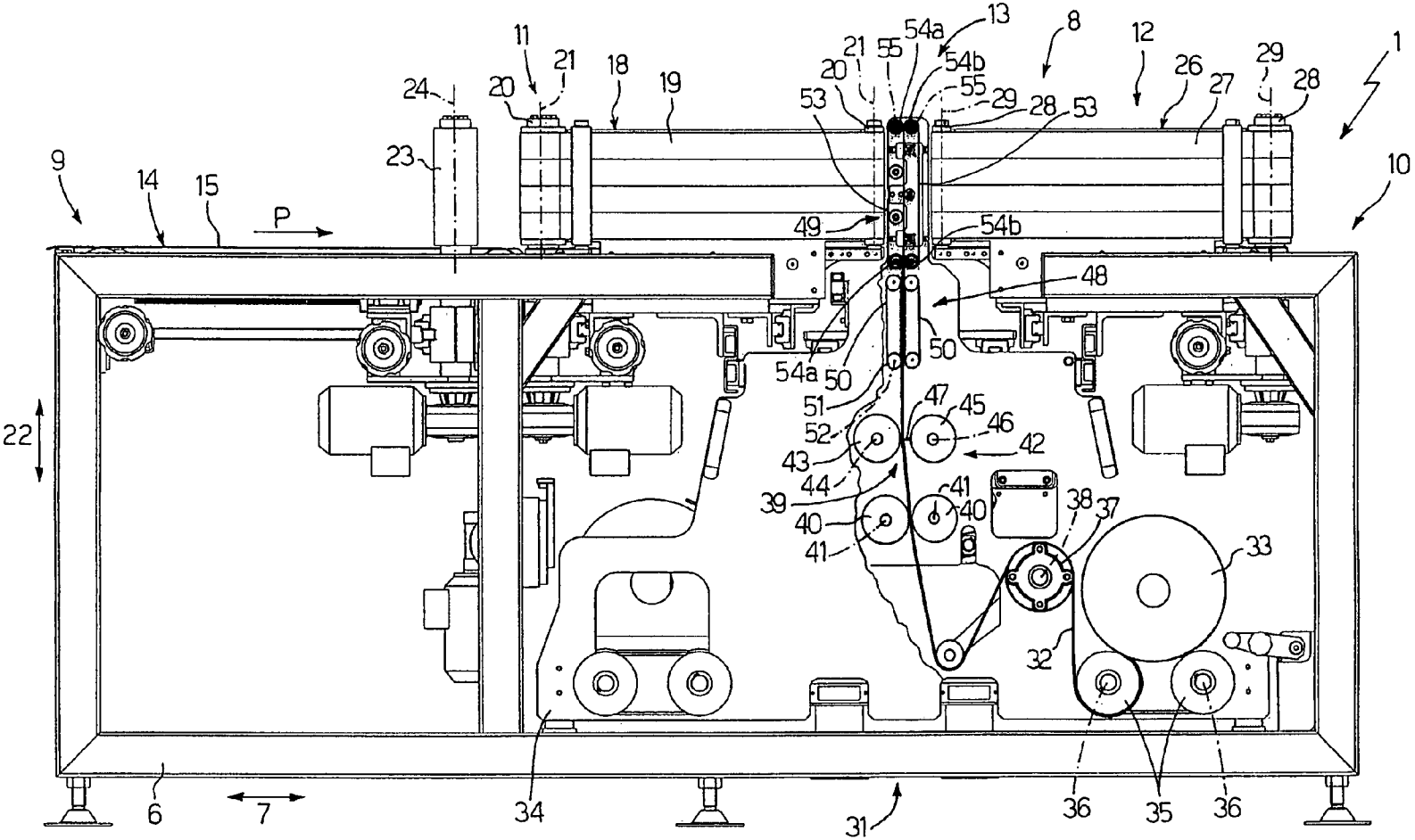
FIG. 2 shows a schematic side view, with parts in section and parts removed for clarity, of the FIG. 1 machine.
Figure 3:
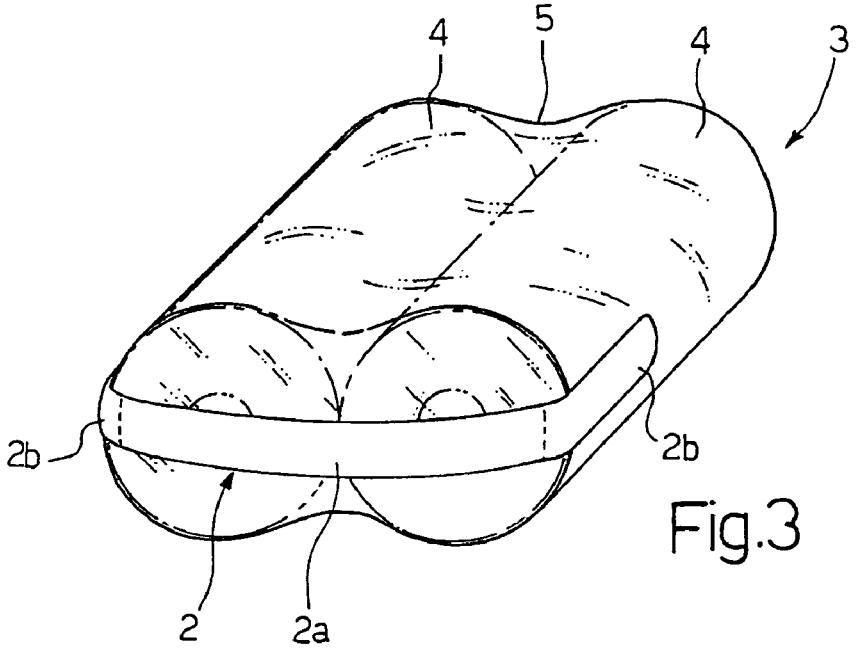
FIG. 3 shows a schematic view in perspective of a product as it comes off the FIG. 1 and 2 machine.

With reference to FIGS. 1 and 3, number 1 indicates as a whole a so-called "handle-fitting" machine for applying partly adhesive straps 2 to relative products 3.

Each product 3 is defined, in the example shown, by two side by side rolls 4 of paper, and by a sheet 5 of plastic packing material enclosing rolls 4. Obviously, in alternative embodiments not shown, the number of rolls 4 in each product 3 is other than two, and each product 3 is defined by articles other than rolls 4.

Machine 1 comprises an elongated base 6 extending in a given direction 7; and a conveying unit 8 for feeding products 3 successively in direction 7 and along a substantially straight path P extending between an input station 9, where products 3 are fed onto machine 1, and an output station 10, where products 3 are fed off machine 1.

Unit 8 comprises two conveying devices 11, 12 arranged in series in direction 7, and connected to each other at a transfer station 13 along path P.

Device 11 comprises an endless conveyor 14 for receiving products 3 at station 9, and in turn comprising a smooth belt 15, which has a horizontal conveying branch, and is looped about two pulleys (not shown)—one of which is powered continuously—fitted to base 6 to rotate about respective longitudinal axes (not shown) parallel to each other and to a horizontal direction 16 crosswise to direction 7.

Conveyor 14 feeds products 3 onto a conveying surface of a lower idle-roller conveyor 17, which cooperates with two lateral endless conveyors 18 to feed products 3 to station 13.

The two conveyors 18 extend in direction 7, are located on opposite sides of path P in direction 16, and each comprise a respective smooth belt 19, which moves in a horizontal plane and is looped about two pulleys 20—one of which is powered continuously—fitted to base 6 to rotate about respective axes 21 parallel to each other and to a vertical direction 22 perpendicular to directions 7 and 16.

Belts 19 have respective vertical conveying branches 19*a* facing each other and separated by a distance substantially equal to the width of a product 3 measured parallel to direction 16 to define a channel along which to feed products 3 in direction 7.

Conveyor 14 is also associated with two feed rollers 23, which are fitted on opposite sides of conveyor 14 in direction 16, and are fitted to base 6 to rotate, with respect to base 6, about respective axes 24 parallel to direction 22. Rollers 23 are powered to impart to products 3 a traveling speed substantially equal to that imparted to products 3 by conveyor 14, and lower than the traveling speed imparted to products 3 by conveyors 18.

Consequently, products 3 are initially conveyed in randomly distributed manner by conveyor 14 and rollers 23, and are then conveyed by conveyors 18 in a succession in which products 3 are spaced apart.

Conveyors 18 feed products 3 onto a conveying surface of a lower idle-roller conveyor 25, which, together with two lateral endless conveyors 26, defines device 12.

The two conveyors 26 extend in direction 7, are located on opposite sides of path P in direction 16, and each comprise a respective smooth belt 27, which moves in a horizontal plane and is looped about two pulleys 28—one of which is powered continuously—fitted to base 6 to rotate about respective axes 29 parallel to each other and to direction 22.

Belts 27 have respective vertical conveying branches 30 facing each other and substantially coplanar with conveying branches 19*a* of belts 19.

Figure 4:
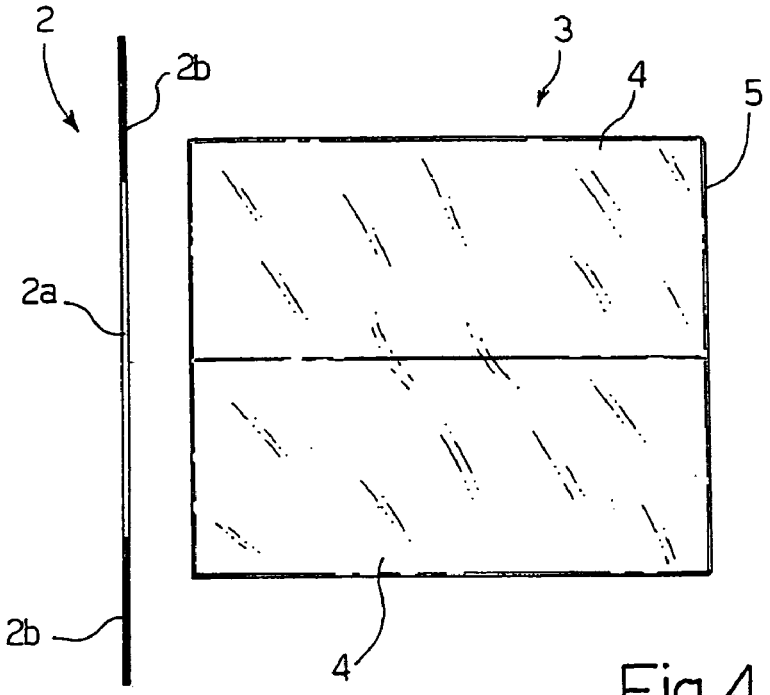
FIG. 4 shows a schematic plan view of one operating step of the FIG. 1 and 2 machine.

Machine 1 also comprises a feed device 31 for supplying station 13 with successive straps 2, each of which is formed, in the example shown, from a reel 33 of strip 32, and is defined by two opposite faces, one of which is completely non-adhesive, and the other of which, as shown in FIGS. 3 and 4, comprises a non-adhesive central portion 2*a* of a length shorter than the width of a product 3 measured parallel to direction 16, and two adhesive lateral portions 2*b*.

Device 31 comprises a carriage 34, which is fitted to run along base 6 and is movable in direction 16, either manually or by means of a known actuating device not shown, between a work position (FIG. 1), in which carriage 34 is substantially housed within base 6, and a rest position (not shown), in which carriage 34 projects outwards of base 6 to simplify maintenance of device 31 and/or the changing of reel 33.

Reel 33 is mounted on two counter-rotating support and unwinding rollers 35—one of which is powered—fitted to carriage 34 to rotate, with respect to carriage 34, about respective axes 36 parallel to direction 16; and strip 32 is wound about one of rollers 35, so that reel 33 is initially unwound downwards.

Strip 32 is also wound about a powered roller 37 fitted to carriage 34 to rotate, with respect to carriage 34, about an axis 38 parallel to axes 36, and is fed to a pre-cut station 39 by two counter-rotating rollers 40 fitted to carriage 34 to rotate, with respect to carriage 34, about respective axes 41 parallel to axes 36 and 38.

Station 39 has a pre-cutting device 42 comprising an idle backing roller 43 fitted to carriage 34 to rotate, with respect to carriage 34, about an axis 44 parallel to axes 41; and a cutting roller 45 fitted to carriage 34 to rotate, with respect to carriage 34, about an axis 46 parallel to axis 44, and having a cutting edge 47, which projects radially from roller 45, and is designed to partly detach a strap 2 from strip 32 at each operating cycle.

Device 31 also comprises two belt conveyors 48 and 49 located in series in the feed direction of strip 32, and of which conveyor 48 comprises two pairs of smooth counter-rotating belts 50 aligned with each other in direction 16. Belts 50 in each pair of belts 50 are positioned substantially contacting each other, with the interposition of strip 32, and are each looped about a respective pair of pulleys 51—one of which is powered—fitted to carriage 34 to rotate, with respect to carriage 34, about respective axes 52 parallel to direction 16.

Conveyor 49 comprises two pairs of smooth, counter-rotating belts 53 (only one pair shown in FIG. 1) located on opposite sides of path P in direction 16; and each pair of belts 53 comprises a belt 53 looped about two pulleys 54*a*,and a belt 53 looped about two pulleys 54*b*.

Pulleys 54*a* and 54*b* are powered to rotate about respective axes 55 parallel to one another and to axes 52, so as to impart to strip 32 a traveling speed greater than that imparted to strip 32 by conveyor 48.

Given the different traveling speeds imparted to strip 32 by conveyors 48 and 49, straps 2, already partly detached from strip 32 at station 39, are detached completely from strip 32 as strip 32 is engaged by conveyor 49.

In connection with the above, it should be pointed out that each pair of pulleys 54*a* is mounted to rotate on carriage 34, and the corresponding pair of pulleys 54*b* is mounted to rotate on a slide (not shown) fitted in known manner to carriage 34 and moved linearly in direction 7, with respect to carriage 34, by a relative actuating cylinder 56. The movement of said slides (not shown) in direction 7 moves belts 53 in each pair of belts 53 between a gripping position (FIG. 1) and a release position (not shown) respectively gripping and releasing straps 2.

Operation of machine 1 will be described with reference to the application of one strap 2 to a relative product 3, and as of the instant in which belts 53 in each pair of belts 53 are set to the gripping position.

The product 3 considered is fed continuously by device 11 along path P to station 13, and, at the same time, the relative strap 2 (shown only partly in FIG. 1) is detached from strip 32 and fed to station 13 so that it is parallel to direction 16 and aligned with the center of product 3 in direction 22.

Since the non-adhesive portion 2*a* is shorter in length than the width of product 3 measured parallel to direction 16, product 3 simultaneously engages both non-adhesive portion 2*a* and adhesive portions 2*b* to ensure strap 2 is positioned correctly on product 3.

At this point, belts 53 in each pair of belts 53 are switched to the release position releasing strap 2, and the whole defined by product 3 and strap 2 is fed into a folding device defined by belts 27 to fold portions 2*b* substantially into a U onto product 3 (FIG. 3).

In a variation not shown, strip 32 is defined by an adhesive face and a non-adhesive face, and feed device 31 has a second reel and, therefore, a second strip, which is defined by two non-adhesive faces, is of a width, measured parallel to direction 16, substantially equal to the length of a portion 2*a* also measured parallel to direction 16, and is superimposed on strip 32 to define, on strip 32, a non-adhesive central portion.

The invention claimed is:

1. A machine for applying partly adhesive straps to relative products, the machine comprising:

an input station;

an output station;

conveying means for feeding the products successively along a substantially straight path extending between said input and output stations;

a folding device located along said path; and a feed device to feed straps onto said path and into a position crosswise to the path, said conveying means feeding each product and the relative strap through said folding device so as to fold the strap into a U about the product, wherein the feed device includes detaching means for detaching said straps from a strip, the detaching means including two further conveying devices located in series and for conveying said strip at respective further different traveling speeds, so as to tear each strap off the strip.

2. A machine as claimed in claim 1, further comprising actuating means for so activating said conveying means as to feed the products continuously along said path.

3. A machine as claimed in claim 1, wherein said conveying means comprise two belt conveyors having respective vertical conveying branches parallel to said path and facing each other to define said folding device.

4. A machine as claimed in claim 1, wherein said conveying means comprise two conveying devices located in series and for conveying the products at respective different traveling speeds, so that the products are fed to said folding device in a succession in which the products are spaced apart.

5. A machine as claimed in claim 1, wherein each said strap comprises two adhesive lateral portions, and a non-adhesive central portion located between said lateral portions; the central portion having a length, measured crosswise to said path, smaller than a width of a product also measured crosswise to said path.

6. A machine as claimed in claim 1, further comprising a fixed base substantially parallel to said path; the feed device further including a supporting carriage movable, with respect to said base and crosswise to said path, between a rest position, in which the carriage projects outwards of the base, and a work position, in which the carriage is substantially housed within the base.

7. A machine as claimed in claim 1, wherein the feed device further includes a pair of rollers to support and to unwind a reel of strip; the strip being wound about one of said rollers.

8. A machine as claimed in claim 1, wherein said detaching means also include cutting means located upstream from said further conveying devices in a traveling direction of said strip, for partly pre-cutting the strip.

9. A machine as claimed in claim 1, wherein the feed device further includes two gripping devices to retain each strap along and crosswise to said path; each gripping device being movable between a release position and a gripping position to respectively release and grip the strap.

10. A machine for applying partly adhesive straps to relative products, the machine comprising:

an input station;

an output station;

conveying means for feeding the products successively along a substantially straight path extending between said input and output stations;

a folding device located along said path; and a feed device to feed straps onto said path and into a position crosswise to the path, said conveying means feeding each product and the relative strap through said folding device so as to fold the strap into a U about the product, wherein said conveying means include two belt conveyors having respective vertical conveying branches parallel to said path and facing each other to define said folding device.

11. The machine of claim 10, further comprising a fixed base substantially parallel to said path, the feed device including a supporting carriage movable, with respect to said base and crosswise to said path, between a rest position, in which the carriage projects outwards of the base, and a work position, in which the carriage is substantially housed within the base.

12. The machine of claim 10 wherein the feed device includes detaching means for detaching said straps from a strip, the detaching means including cutting means located upstream in a traveling direction of said strip, for partly pre-cutting the strip.

13. The machine of claim 12 wherein the detaching means further includes two further conveying devices located in series and for conveying said strip at respective further different traveling speeds, so as to tear each strap off the strip.

14. A machine for applying partly adhesive straps to relative products, the machine comprising:

an input station;

an output station;

conveying means for feeding the products successively along a substantially straight path extending between said input and output stations;

a folding device located along said path;

a feed device to feed straps onto said path and into a position crosswise to the path, said conveying means feeding each product and the relative strap through said folding device so as to fold the strap into a U about the product; and a fixed base substantially parallel to said path, the feed device including a supporting carriage movable, with respect to said base and crosswise to said path, between a rest position, in which the carriage projects outwards of the base, and a work position, in which the carriage is substantially housed within the base.

15. The machine of claim 14 wherein the feed device includes detaching means for detaching said straps from a strip, the detaching means including cutting means located upstream in a traveling direction of said strip, for partly pre-cutting the strip.

16. The machine of claim 15 wherein the detaching means further includes two further conveying devices located in series and for conveying said strip at respective further different traveling speeds, so as to tear each strap off the strip.

* * * * *